US010707030B2

(12) United States Patent
Hikawa et al.

(10) Patent No.: US 10,707,030 B2
(45) Date of Patent: Jul. 7, 2020

(54) SWITCH

(71) Applicant: Satori Electric Co., Ltd., Tokyo (JP)

(72) Inventors: Sei Hikawa, Tokyo (JP); Shinsuke Tanaka, Tokyo (JP); Isao Inagaki, Tokyo (JP)

(73) Assignee: SATORI ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/392,939

(22) Filed: Apr. 24, 2019

(65) Prior Publication Data

US 2020/0006019 A1 Jan. 2, 2020

(30) Foreign Application Priority Data

Jun. 29, 2018 (JP) ..... 2018-124637

(51) Int. Cl.
*H01H 13/06* (2006.01)
*H01H 13/14* (2006.01)
*H01H 13/52* (2006.01)

(52) U.S. Cl.
CPC ..... *H01H 13/06* (2013.01); *H01H 13/14* (2013.01); *H01H 13/52* (2013.01)

(58) Field of Classification Search
CPC ..... H01H 13/06; H01H 13/14; H01H 13/52; H01H 3/48; H01H 9/063; H01H 1/5833; H01H 9/061; H01H 13/08; H01H 2001/0005; H01H 9/52; H01H 9/40
USPC ..... 200/302.2, 522
See application file for complete search history.

(56) References Cited

U.S. PATENT DOCUMENTS 4,864,083 A 9/1989 Bittel
7,297,891 B2 * 11/2007 Omori ..... H01H 3/48 200/522
7,638,725 B2 * 12/2009 Aoki ..... H01H 9/063 200/332.2
7,705,260 B2 * 4/2010 Xu ..... H01H 1/5833 200/43.17
8,089,019 B2 * 1/2012 Inagaki ..... H01H 9/063 200/522
2012/0234657 A1 9/2012 Nishikimi et al.
2013/0140167 A1 6/2013 Kobayashi
(Continued)

FOREIGN PATENT DOCUMENTS

EP 2 600 369 6/2013
EP 2 767 997 8/2014
(Continued)

OTHER PUBLICATIONS

Extended European Search Report dated Dec. 6, 2019 in corresponding European Patent Application No. 19170861.9.

*Primary Examiner* — Edwin A. Leon
(74) *Attorney, Agent, or Firm* — Wenderoth, Lind & Ponack, L.L.P.

(57) ABSTRACT

A housing includes a case member having an opened front face, and a cover member firmly fixed with the case member to close the opened front face of the case member. The case member has a penetration hole penetrating its side face. A movable part includes an inner member disposed inside the housing to control a circuit, and an outer member being a discrete piece from the inner member and exposed outside the housing to be manipulated by a user. The outer member includes a shaft part inserted through the penetration hole.

8 Claims, 8 Drawing Sheets

(56) References Cited

U.S. PATENT DOCUMENTS

| | | | | |
|---|---|---|---|---|
| 2014/0225331 | A1 | 8/2014 | Hozumi et al. | |
| 2019/0228926 | A1* | 7/2019 | Koyama | B25F 5/00 |

FOREIGN PATENT DOCUMENTS

| | | |
|---|---|---|
| JP | 2012-206248 | 10/2012 |
| WO | 89/09997 | 10/1989 |

* cited by examiner

*Fig. 5*
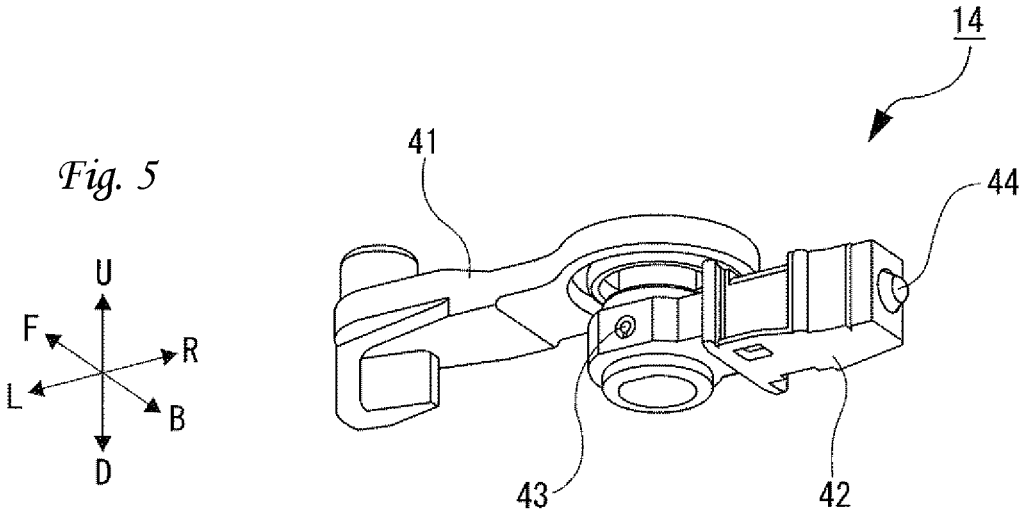
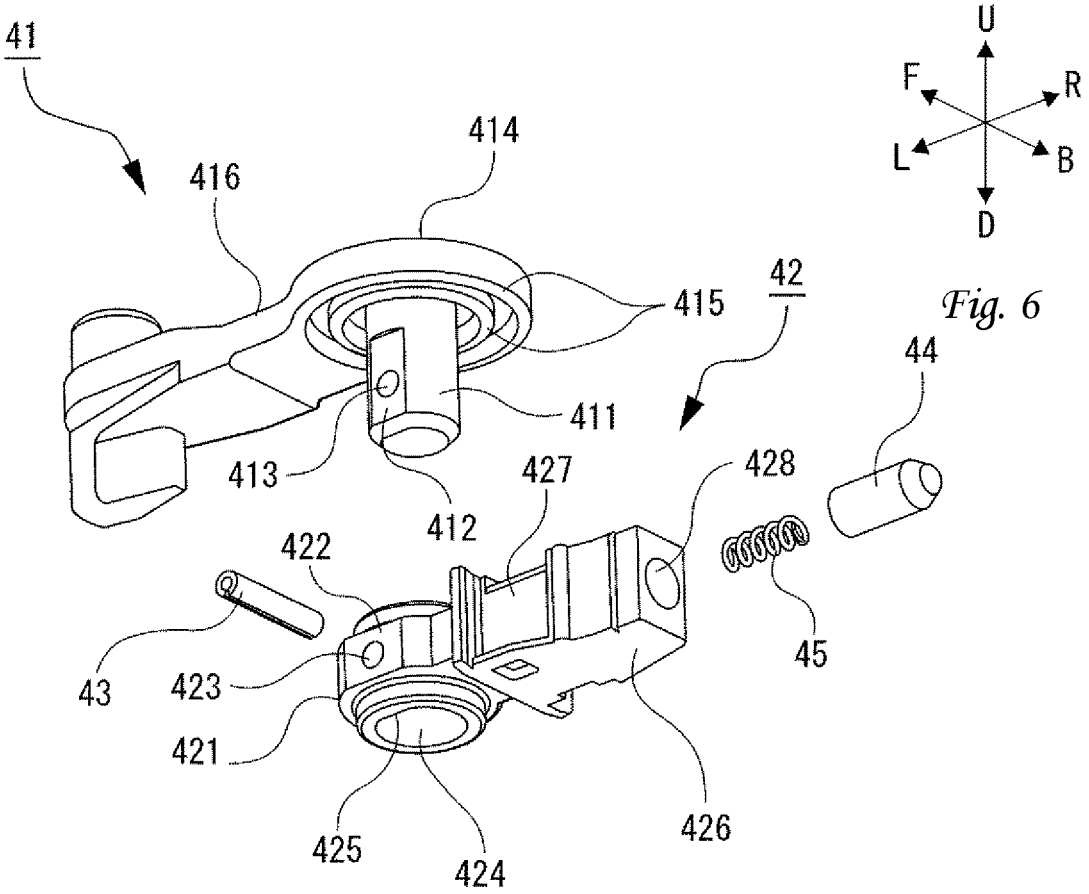
*Fig. 6*

SWITCH

TECHNICAL FIELD

The present invention is related to a switch, more specifically, a dustproof structure of a housing of a switch.

BACKGROUND ART

JP2012-206248A discloses a trigger switch, which comprises a housing accommodating a switching mechanism or other circuit, and a trigger or other movable part. The movable part is manipulated for controlling the circuit.

In order to assemble components into the housing, the housing is formed by two separate pieces, that is, a case and a cover. For preventing invasion of the housing by dust through a gap between the case and the cover, the cover is adhered with the case.

The housing has a hole where the movable part passes through it. The hole is disposed at a boundary between the case and the cover. By assembling the movable part to the case before the cover is attached on the case, the assembling is facilitated even when the movable part has a cranking or other complicated shape.

SUMMARY OF INVENTION

Technical Problem

However, the hole disposed at the boundary between the case and the cover complicates a shape of the boundary between the case and the cover.

This requires high accuracy of processing the case and the cover. Low processing accuracy of the case and the cover results in a gap at the boundary between the case and the cover. This creates a risk that dust invade the housing through the gap.

Furthermore, complexity of the shape of the boundary part between the case and the cover increases labor for applying adhesive material in a case that they are adhered with the adhesive material. Also, in a case that they are welded with ultrasonic waves, it increases a risk of incomplete welding at a part having an angle with respect to a pressing direction.

If the hole where the movable part passes through it is a penetration hole penetrating through the case to be isolated from the boundary, the shape of the boundary part between the case and the cover can be more simplified. However, this makes it difficult to assemble a movable part having a cranking or other complicated shape.

The present invention aims to solve the above-mentioned or other problem, and to improve sealability of the housing.

Solution to Problem

A switch according to the present invention includes a housing having a hollow box shape, a circuit provided inside the housing, and a movable part to be manipulated by a user to control the circuit. The housing includes a case member having an opened front face, and a cover member firmly fixed with the case member to close the opened front face of the case member. The case member has a penetration hole penetrating its side face. The movable part includes an inner member disposed inside the housing to control the circuit, and an outer member being a discrete piece from the inner member, and exposed outside the housing to be manipulated by the user. The outer member includes a shaft part inserted through the penetration hole.

The movable part may pivot on the shaft part. The inner member may have a fitting hole. The shaft part may have a first end inserted into the fitting hole. The first end of the shaft part may be fitted into the fitting hole to cause the inner member to pivot integrally with the outer member.

The movable part may include a fixing member for fixing the outer member and the inner member. The outer member may include a circular disc part provided at a second end of the shaft part. When the fixing member fixes the outer member and the inner member, a labyrinthine structure may be formed between the circular disc part and the side face of the case member.

The case member may include a recessed part provided around the penetration hole to engage with the circular disc part. The circular disc part may have an outer face on substantially the same plane as the side face of the case member.

When the fixing member does not fix the outer member and the inner member, the outer member may be allowed to move in an axial direction with respect to the inner member with retaining the first end of the shaft part to fit into the fitting hole.

The inner member may include a circular ring part having a fitting hole provided at its center. The inner member may include an actuation part extending from the circular ring part toward a radial direction. Before the cover member closes the opened front face of the case member, the outer member pivoting with the first end of the shaft part fitted into the fitting hole may enable a tip of the actuation part to expose out of the opened front face of the case member.

The case member may include a receiving part on its inner side to engage with the circular ring part. The circular ring part may be engaged with the receiving part to enable the fitting hole to be positioned substantially coaxially with the penetration hole.

The movable part may linearly move along an axial direction of the shaft part. The inner member may include an abutting part for abutting the shaft part. When the outer member is linearly moved into the housing, the shaft part may press against the abutting part to linearly move the inner member integrally with the outer member.

Advantageous Effects of the Invention

According to the present invention, the penetration hole is provided with penetrating the case member to pass the shaft part of the movable part through it. This enables to simplify a shape of a boundary part between the case member and the cover member. Thus, the housing can have improved sealability.

The inner member and the outer member are provided as discrete pieces. This facilitates to assemble the movable part to pass through the penetration hole even when it has a complicated shape.

The inner member pivoting integrally with the outer member enables a user to control the circuit provided inside the housing by manipulating the outer member to pivot, because the inner member pivots along with it.

The labyrinthine structure formed between the circular disc part of the outer member and the side face of the case member when the fixing member fixes the outer member and the inner member enables to prevent invasion of the housing by dust through the penetration hole.

The circular disc part having the outer face on substantially the same plane as the side face of the case member enables to prevent invasion of the housing by dust accumulated in a level difference between them.

The outer member allowed to move in the axial direction with respect to the inner member with retaining the first end of the shaft part to fit into the fitting hole when the fixing member does not fix the outer member and the inner member enables to increase a range where the outer member pivots, and thereby to facilitate to assemble the switch. For example, the tip of the actuation part is facilitated to expose from the opened front face of the case member.

The fitting hole allowed to be positioned substantially coaxially with the penetration hole by engaging the circular ring part with the receiving part enables to facilitate to assemble the switch.

The inner member linearly moving integrally with the outer member enables a user to control the circuit provided inside the housing when he pushes the outer member, because the inner member moves along with it.

BRIEF DESCRIPTION OF DRAWINGS

FIG. 5 is an enlarged perspective view illustrating an example of a movable part;

FIG. 6 is an exploded and enlarged perspective view illustrating an example of a movable part;

DESCRIPTION OF EMBODIMENT

Figure 1:
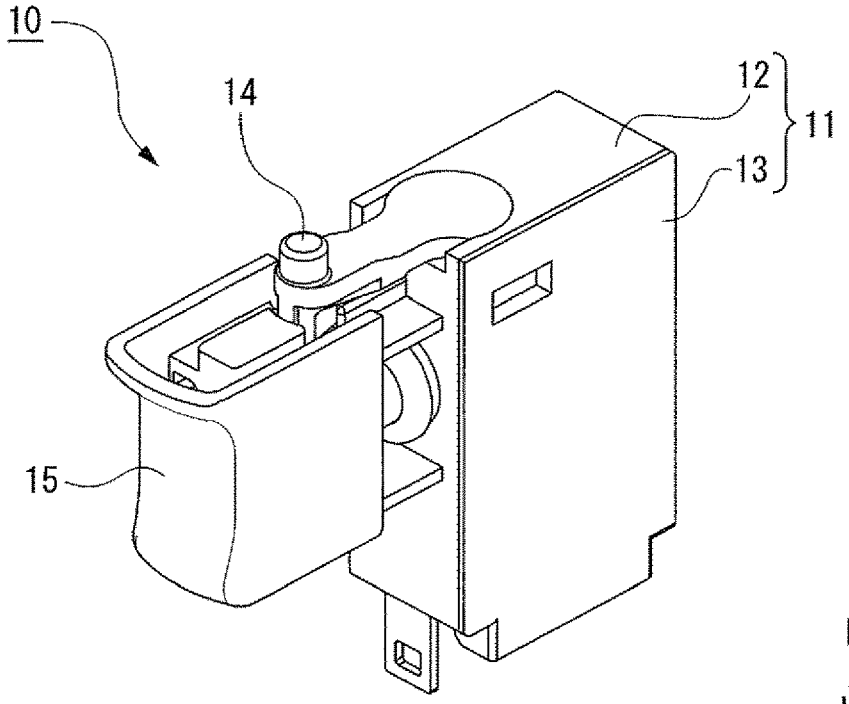
FIG. 1 is a perspective view illustrating an example of a switch.

Referring to FIG. 1, a switch 10 is an apparatus to be manipulated by a user to generate a signal for controlling behavior of an electric circuit. The switch 10 includes the followings.

<A housing 11> It has a hollow box shape to accommodate a circuit. The circuit is electrically connected to the electric circuit to be controlled and constitutes a part of it. The housing 11 includes a case member 12, and a cover member 13. The case member 12 and the cover member 13 are welded with ultrasonic waves, or otherwise firmly fixed, with one other. This achieves to prevent invasion of the housing 11 by dust or other through a gap between the case member 12 and the cover member 13.

<A movable part 15> It is manipulated by the user to linearly move along a direction substantially parallel to L-R direction. For example, the switch 10 generates a signal for controlling electric power supplied to a motor according to an extent to which the user pulls the movable part 15 in, or otherwise controlling behavior of the electric circuit according to a position of the movable part 15. The signal may be a control signal for directly controlling the behavior of the electric circuit, or may be a detection signal for inputting to a control circuit provided outside the switch 10 to control the behavior of the electric circuit. The control signal or the detection signal may be expressed by making/breaking of a circuit, or by a resistance value or other electrical characteristic value.

<A movable part 14> It is manipulated by the user to pivot on an axis substantially parallel to U-D direction to control the circuit. For example, the switch 10 generates a signal for controlling a rotational direction of the motor according to the position to which the user causes the movable part 14 to pivot, or otherwise controlling the behavior of the electric circuit according to the position of the movable part 14.

Figure 2:
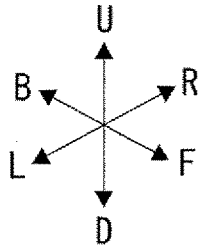
FIG. 2 is a perspective view illustrating an example of a switch where a cover member and a circuit board is taken away.
Figure 2:
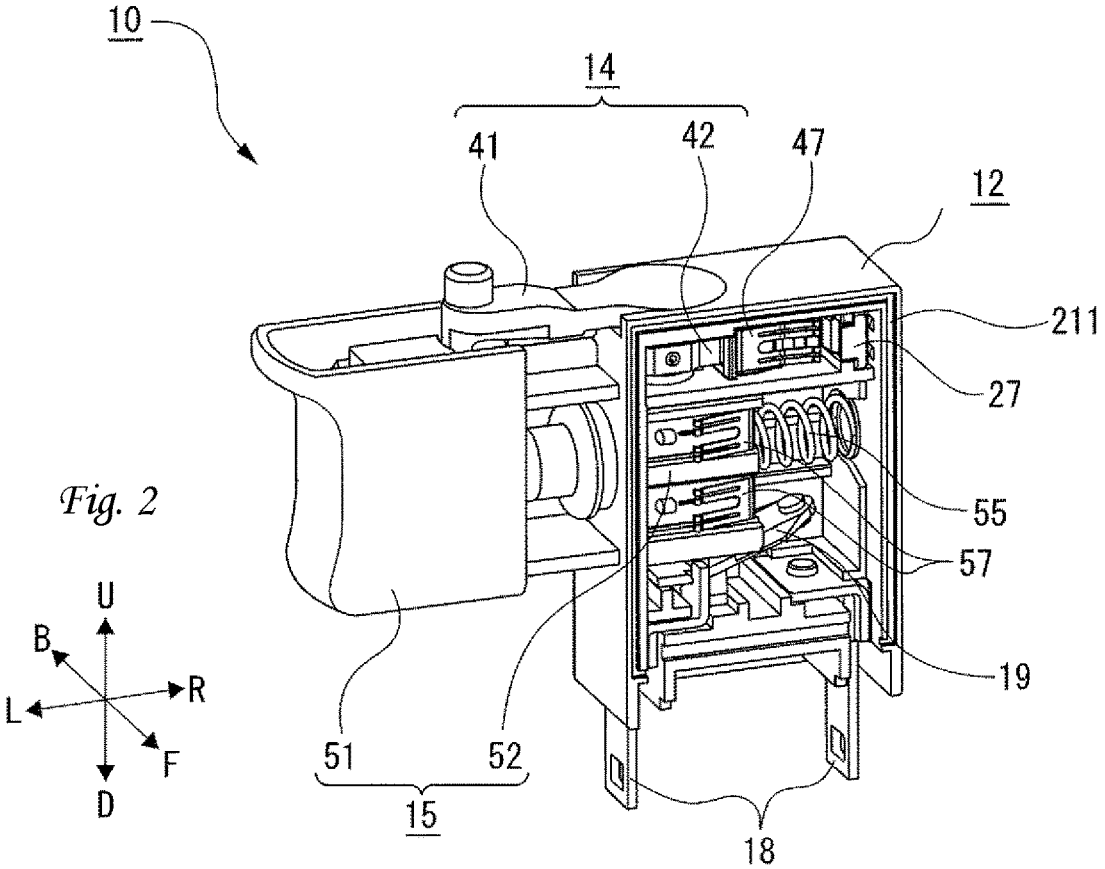

Referring to FIG. 2, the switch 10 further includes the followings.

<A click feeling part 27> It is disposed in the case member 12. The click feeling part 27 may be formed integrally with the case member 12, or may be a discrete piece from the case member 12.

<A biasing member 55> It is a compression coil spring or other member for generating a restoring force against compression. It is disposed in the case member 12, and generates a restoring force caused by compression along a direction substantially parallel to L-R direction, to bias the movable part 15 toward L direction.

<Two fixed contact pieces 18> They are fitted and fixed with the case member 12. Each of the fixed contact pieces 18 has a part exposed out of the housing 11, to be electrically connected with a wiring from the external electric circuit.

<A movable contact piece 19> It pivots along movement of the movable part 15 to connect/break between the fixed contact pieces 18.

The movable part 14 includes the followings.

<An inner member 42> It is disposed in the housing 11 to actuate the circuit. A movable contact piece 47 is fixed with the inner member 42.

<An outer member 41> It is a discrete piece from the inner member 42, and fixed with the inner member 42. It is exposed outside the housing 11, to be manipulated by the user.

The movable part 15 includes the followings.

<An inner member 52> It is disposed in the housing 11 to actuate the circuit. Two movable contact pieces 57 are fixed with the inner member 52.

<An outer member 51> It is a discrete piece from the inner member 52. It is exposed outside the housing 11, to be manipulated by the user.

Figure 3:
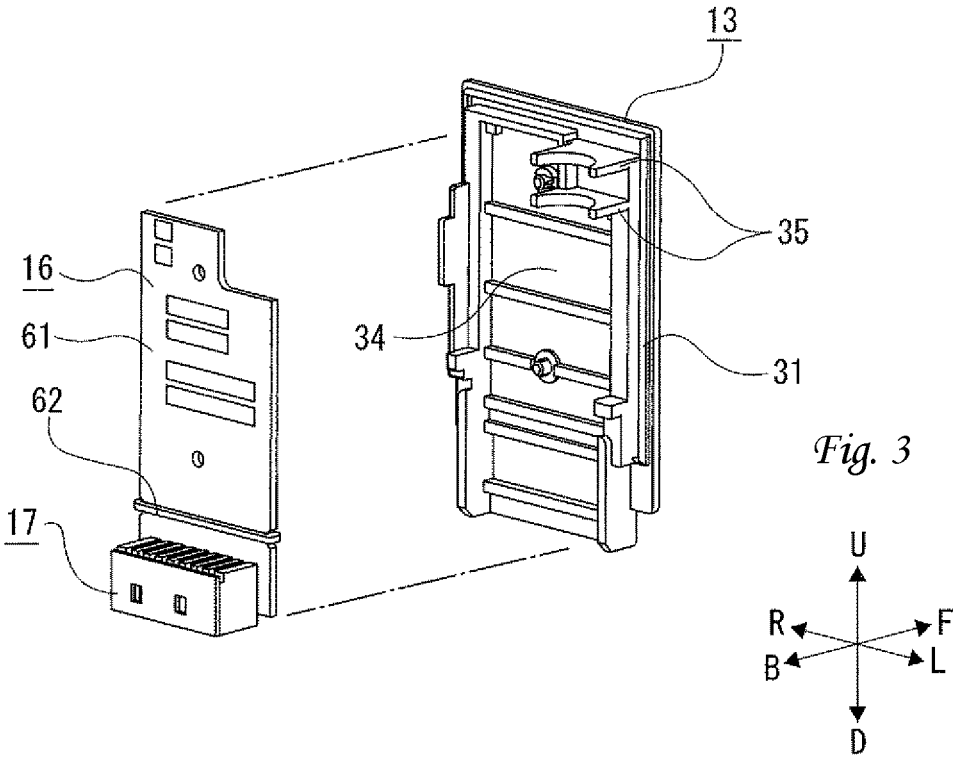
FIG. 3 is a perspective view illustrating an example of a circuit board and a cover member.

Referring to FIG. 3, the switch 10 further includes the followings.

<A circuit board 16> It is disposed in the housing 11. The circuit board 16 has a printed circuit or other circuit 61 formed on it. The circuit 61 contacts with/separates from the movable contact pieces 47 and 57, or otherwise detects a position of the movable parts 14 and 15. The circuit board 16 has a part exposed outside the housing 11.

<A terminal 17> It is disposed outside the housing 11, fixed with the circuit board 16 by soldering or other means, and electrically connected with the circuit 61. The terminal 17 is to be electrically connected with a wiring from the external electric circuit, to electrically connect the circuit 61 to the external electric circuit.

<A packing 62> It is a rubber ring or other sealing member, and wound around the circuit board 16. This prevents invasion of the housing 11 by dust or other through a gap between the circuit board 16 and the housing 11.

The cover member 13 includes the followings.

<A front face part 34> It has a substantially rectangular plate shape substantially perpendicular to F-B direction.

<An elongate protrusion 31> It protrudes from a face on B side of the front face part 34 and extends along its periphery. The elongate protrusion 31 is a paste margin for ultrasonic welding of the cover member 13 with the case member 12. The elongate protrusion 31 protrudes from a substantially single plane toward a direction substantially perpendicular to the plane. The cover member 13 has a part on D side without the elongate protrusion 31 on its periphery. This causes to form a gap between it and the case member 12 to expose a part of the circuit board 16 outside the housing 11 through it.

<Two receiving parts 35> They have plate shapes substantially perpendicular to U-D direction, and protrude from a face on B side of the front face part 34 toward B direction. Each of the receiving parts 35 has a tip having a semicircular concave shape to engage with the movable part 14.

Figure 4:
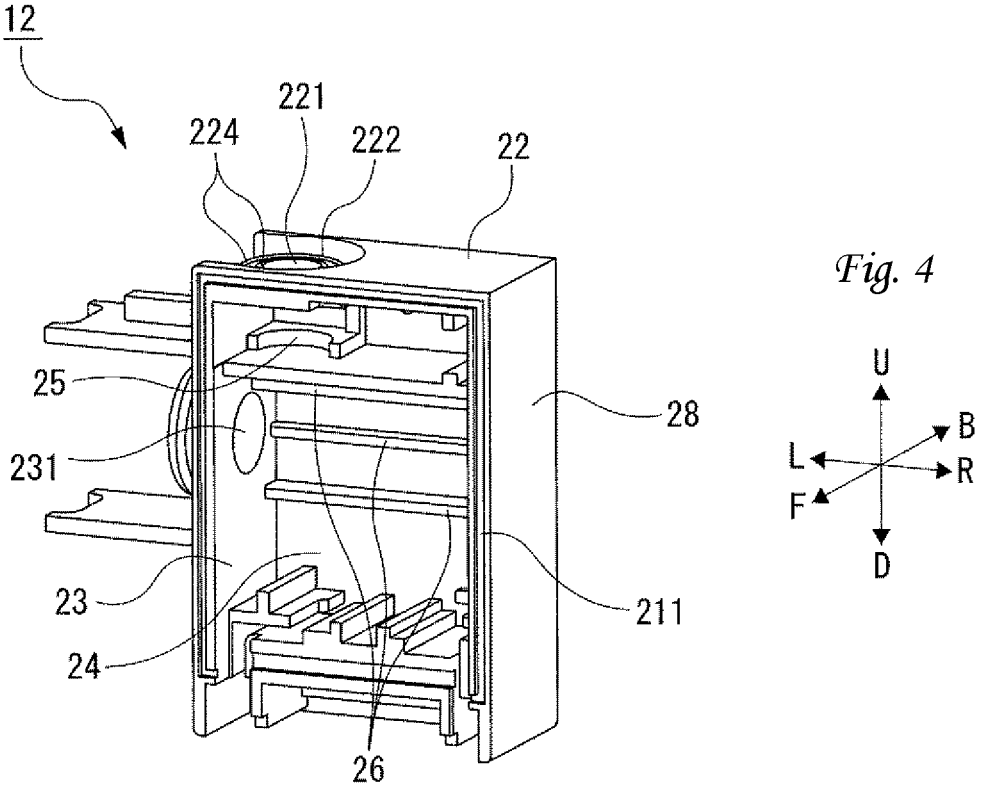
FIG. 4 is a perspective view illustrating an example of a case member.

Referring to FIG. 4, the case member 12 has a substantially rectangular parallelepiped box shape with an opening on F side entirely, and includes the followings.

<A back face part 24> It has a substantially rectangular plate shape substantially perpendicular to F-B direction.

<A upper side face part 22> It has a substantially rectangular plate shape substantially perpendicular to U-D direction, and extends from an end on U side of the back face part 24 toward F direction.

<A left side face part 23> It has a substantially rectangular plate shape substantially perpendicular to L-R direction, and extends from an end on L side of the back face part 24 toward F direction. It has an end on U side linked with an end on L side of the upper side face part 22.

<A right side face part 28> It has a substantially rectangular plate shape substantially perpendicular to L-R direction, and extends from an end on R side of the back face part 24 toward F direction. It has an end on U side linked with an end on R side of the upper side face part 22.

<A groove 211> It extends along a periphery of the opening, and is dented from ends on F sides of the upper side face part 22, the left side face part 23 and the right side face part 28. The groove 211 corresponds to the elongate protrusion 31 of the cover member 13, and is to be welded to the elongate protrusion 31. The groove 211 is dented from a substantially single plane toward a direction substantially perpendicular to the plane. This achieves high reliability of the welding to prevent invasion by dust.

Figure 12:
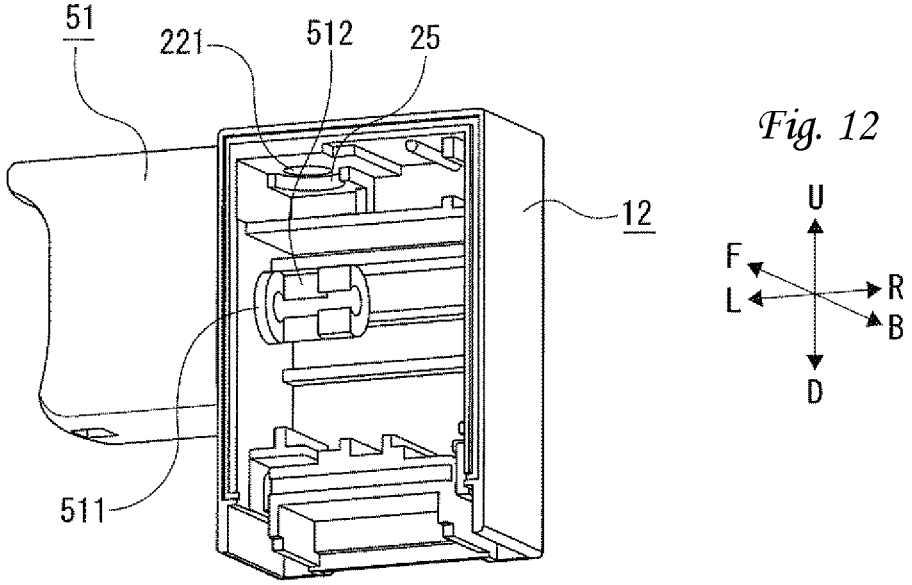
FIG. 12 is a perspective view illustrating an example of a process for assembling a switch.

<Two receiving parts 25> They have plate shapes substantially perpendicular to U-D direction, and protrude from a face on F side of the back face part 24 toward F direction. One of the receiving parts 25 is shown here, and the other is shown in FIG. 12. Each of the receiving part 25 has a tip having a semicircular concave shape to engage with the movable part 14. They cooperate with the receiving parts 35 of the cover member 13 to support the movable part 14 so as to be allowed to pivot.

<Three guiding parts 26> They have plate shapes substantially perpendicular to U-D direction, protrude from the face on F side of the back face part 24 toward F direction, and extend from the left side face part 23 to the right side face part 28 in L-R direction. The guiding parts 26 engage with the movable part 15 to guide linear movement of the movable part 15.

Figure 7:
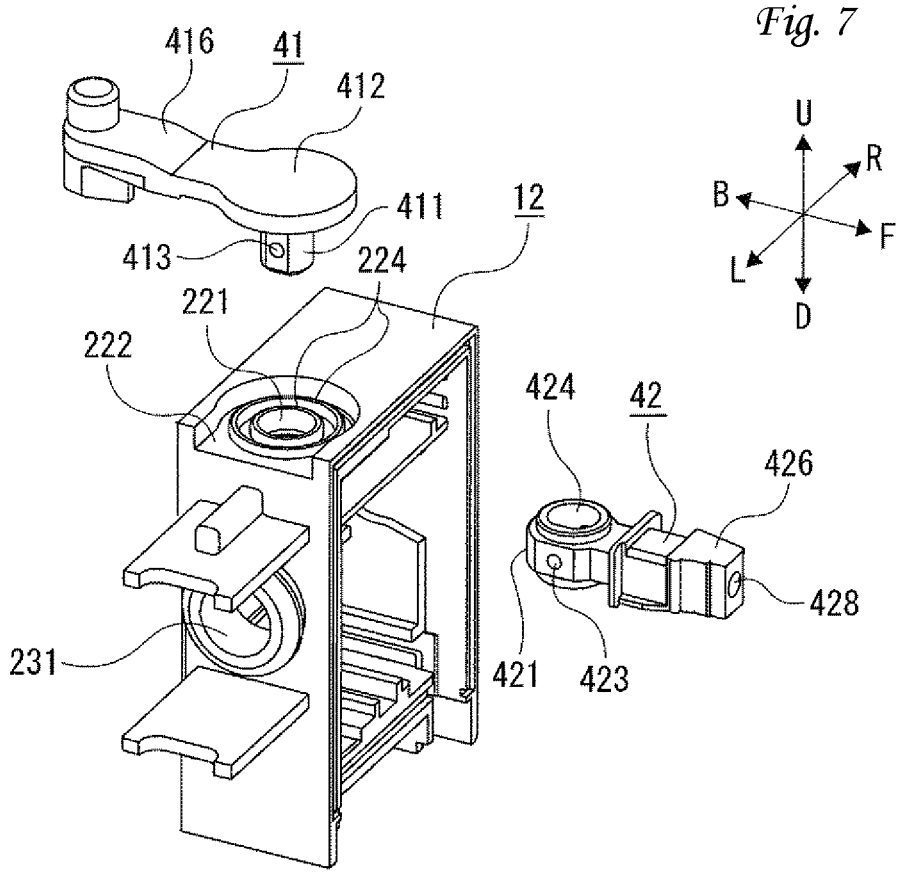
FIG. 7 is a perspective view illustrating an example of a process for assembling a switch.

Referring to FIG. 7 as well, the upper side face part 22 includes the followings.

<A penetration hole 221> It is a hole having a substantially circular shape and an axis substantially parallel to U-D direction, and penetrates the upper side face part 22. That is, it is isolated from the end on F side of the upper side face part 22. In the upper side face part 22, it is positioned at a substantial middle in F-B direction, and near an end on L side in L-R direction.

<A recessed part 222> It is dented from a face on U side of the upper side face part 22 toward D direction, and has a bottom having a shape formed by combining a substantially rectangular shape and a substantially circular shape. A part with the substantially circular shape has substantially the same axis as the penetration hole 221. A part with the substantially rectangular shape has a width smaller than a diameter of the part with the substantially circular shape, and communicates between the part with the substantially circular shape and an end on L side of the upper side face part 22.

<Two ring-shaped protrusion 224> They protrude from the bottom of the recessed part 222 toward U direction. Each of them has a center substantially the same as the center of the penetration hole 221.

The left side face part 23 includes the followings.

<A penetration hole 231> It is a hole having a substantially circular shape and an axis substantially parallel to L-R direction, and penetrates the left side face part 23. That is, it is isolated from the end on F side of the left side face part 23.

Referring to FIG. 5, the movable part 14 further includes the followings.

<A fixing member 43> It fixes the outer member 41 and the inner member 42.

<A push rod 44> It is disposed at an end on R side of the inner member 42, and allowed to linearly move in a direction substantially parallel to a longitudinal direction of the inner member 42. It abuts the click feeling part 27 to cooperate with it to create click feeling when the user causes the movable part 14 to pivot.

Referring to FIG. 6, the outer member 41 includes the followings.

<A shaft part 411> It has a substantially circular column shape and an axis substantially parallel to U-D direction. It has a diameter slightly smaller than the diameter of the penetration hole 221 of the case member 12. When assembled, the outer member 41 pivots on the shaft part 411. It has a planed part 412 provided on F side. The planed part 412 has a shape flattened by shaving a side face of the shaft part 411. Also, it has a fixation hole 413 penetrating it from the planed part 412 toward a direction substantially perpendicularly crossing the axis of the shaft part 411.

<A circular disc part 414> It has a substantially circular plate shape substantially perpendicular to U-D direction, and substantially the same axis as the shaft part 411. It has a diameter slightly smaller than the diameter of the part with the substantially circular shape of the recessed part 222 of the case member 12, and a thickness substantially the same as a depth of the recessed part 222 of the case member 12. When assembled, A face on U side of the circular disc part 414 is on substantially the same plane as the face on U side of the upper side face part 22 of the case member 12. This enables to eliminate a risk that dust may invade the housing 11 caused by accumulation of dust in a level difference between them.

<Two ring-shaped protrusions 415> They protrude from a face on D side of the circular disc part 414 toward D direction. Each of them has a center substantially the same as the center of the circular disc part 414. When assembled, the ring-shaped protrusions 415 engage alternately with the ring-shaped protrusions 224 of the case member 12 to form a labyrinthine structure. This enables to prevent invasion of the housing 11 by dust from a gap between the circular disc part 414 and the recessed part 222.

<A manipulation part 416> It extends from the circular disc part 414 toward a direction substantially perpendicular to U-D direction and a penetrating direction of the fixation hole 413. When assembled, the user can take the manipulation part 416 to cause the movable part 14 to pivot. At this time, the manipulation part 416 meets a side face in the recessed part 222 of the case member 12 to restrict a pivoting range of the movable part 14.

The inner member 42 includes the followings.

<A circular ring part 421> It has a substantially circular cylindrical shape and an axis substantially parallel to U-D direction. The circular ring part 421 has parts near ends on U side and D side with a diameter smaller than that of a middle part. They engage with the receiving parts 25, 35 of the case member 12 and the cover member 13 to be supported and allowed to pivot. The circular ring part 421 has a fitting hole 424 having substantially the same axis as it. The fitting hole 424 has a substantially circular column shape, and a diameter slightly larger than the diameter of the shaft part 411 of the outer member 41. The fitting hole 424 has a flat part 425 on F side of its inner face, which corresponds to the planed part 412 of the shaft part 411. When assembled, engagement of the flat part 425 with the planed part 412 enables the inner member 42 and the outer member 41 to integrally pivot, even when they are not fixed with the fixing member 43. Also, the circular ring part 421 has a planed part 422 on F side of its outer face. The planed part 422 is a marker for facilitating to identify a position of the flat part 425 during assembling. The circular ring part 421 has a fixation hole 423 penetrating it from the planed part 422 toward a direction substantially perpendicular to the axis of the circular ring part 421. The fixation hole 423 intersects the fitting hole 424, and communicates with the fixation hole 413 of the outer member 41 when assembled.

<An actuation part 426> It extends from the circular ring part 421 toward a direction substantially perpendicular to U-D direction and a penetrating direction of the fixation hole 423. The actuation part 426 has an engagement part 427 on F side of its side face to fix the movable contact piece 47. Also, the actuation part 426 has an insertion hole 428 dented from a tip on R side along its longitudinal direction. The insertion hole 428 is a hole for mounting the push rod 44 into it.

The fixing member 43 is, for example, a plate spring rolled to form a substantially circular cylindrical shape with a narrow gap. When assembled, it is inserted through the fixation hole 423, 413 of the inner member 42 and the outer member 41 to fix the outer member 41 and the inner member 42.

The movable part 14 further includes the followings.

<A biasing member 45> It is a compression coil spring or other member for generating a restoring force against compression. It is disposed in the insertion hole 428, and generates a restoring force caused by compression in a direction substantially parallel to the longitudinal direction of the actuation part 426, to bias the push rod 44 outward. When assembled, this causes a tip of the push rod 44 abuts the click feeling part 27, to create click feeling.

Figure 8:
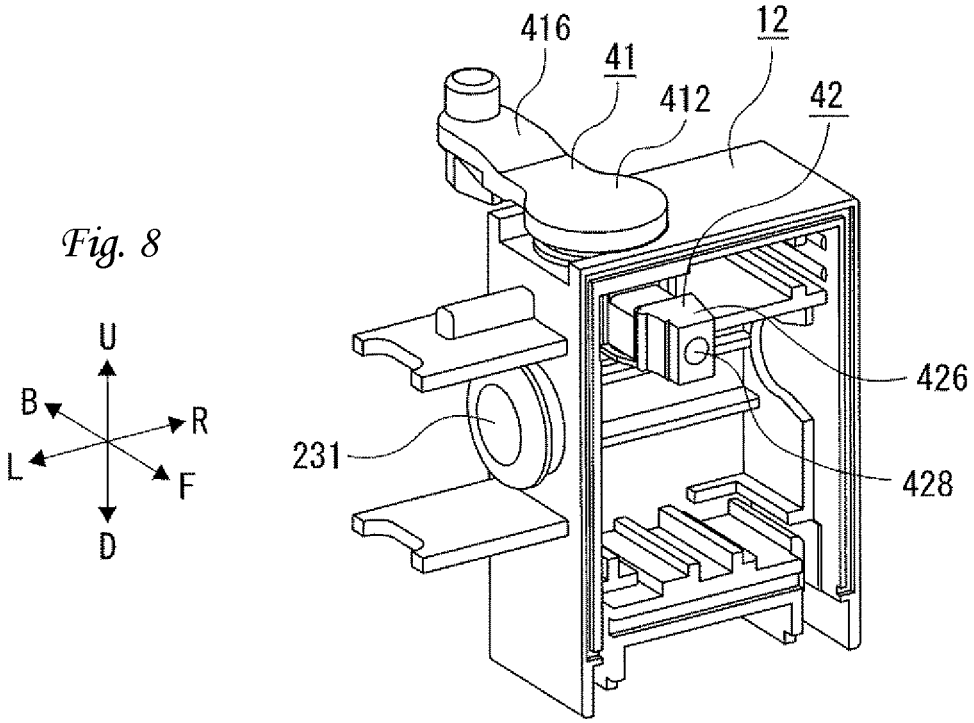
FIG. 8 is a perspective view illustrating an example of a process for assembling a switch.

Referring to FIGS. 7 and 8, a process is illustrated for assembling the movable part 14 to the case member 12.

First, the actuation part 426 of the inner member 42 is took to insert the circular ring part 421 of the inner member 42 into the case member 12 through the opening of the case member 12, and to press it against the receiving part 25 of the case member 12. This causes the fitting hole 424 of the inner member 42 to be positioned substantially coaxially with the penetration hole 221 of the case member 12.

Next, the manipulation part 416 of the outer member 41 is took to insert the shaft part 411 of the outer member 41 through the penetration hole 221 of the case member 12 into the case member 12, and to engage the tip of the shaft part 411 with the fitting hole 424 of the inner member 42.

In this state, a face on D side of the manipulation part 416 of the outer member 41 abuts the upper side face part 22 of the case member 12. This blocks the outer member 41 from reaching a position where the fixation hole 413 communicates with the fixation hole 423. However, when the outer member 41 pivots, the inner member 42 pivots integrally with the outer member 41, because the tip of the shaft part 411 engages with the fitting hole 424. This facilitates the tip of the inner member 42 to expose out of the case member 12, and thereby facilitates insertion of the biasing member 45 and/or the push rod 44 into the insertion hole 428, or other assembling work.

Then, the outer member 41 is caused to pivot to be substantially parallel to L-R direction. This enables the actuation part 416 to get into the recessed part 222, and thereby the outer member 41 to further move toward D direction. By doing so, the fixation hole 413 communicates with the fixation hole 423 along F-B direction. This enables to insert the fixing member 43 from F direction through them, to fix the outer member 41 with the inner member 42. This prevents the outer member 41 from falling out toward U direction.

Figure 9:
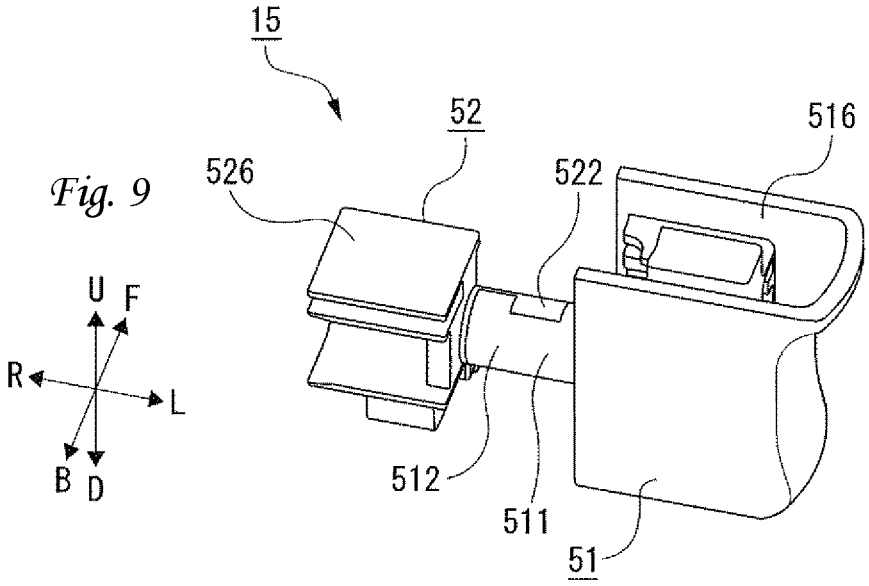
FIG. 9 is a perspective view illustrating an example of a movable part.

Referring to FIG. 9, the outer member 51 includes the followings.

<A shaft part 511> It has a substantially circular column shape extending toward a direction substantially parallel to L-R direction. It has a diameter slightly smaller than the diameter of the penetration hole 231 of the case member 12. When assembled, the outer member 51 linearly moves along the shaft part 511. The shaft part 511 has an engagement part 512 at its tip on R side, for engaging with the inner member 52.

<A manipulation part 516> It is provided an end on L side of the shaft part 511. When assembled, the user grips the manipulation part 516 to move the movable part 15 toward R direction. When the user relaxes the gripping force on the manipulation part 516, the biasing force by the biasing member 55 pushes the movable part 15 back toward L direction.

The inner member 52 includes the followings.

<An actuation part 526> It has a substantially rectangular parallelepiped box shape, and opening on R side and B side. The biasing member 55 engages in the actuation part 526.

<An engagement part 522, or abutting part> It is provided on L side of the actuation part 526. It engages with the engagement part 512 of the outer member 51 to fix the inner member 52 with the outer member 51.

Figure 10:
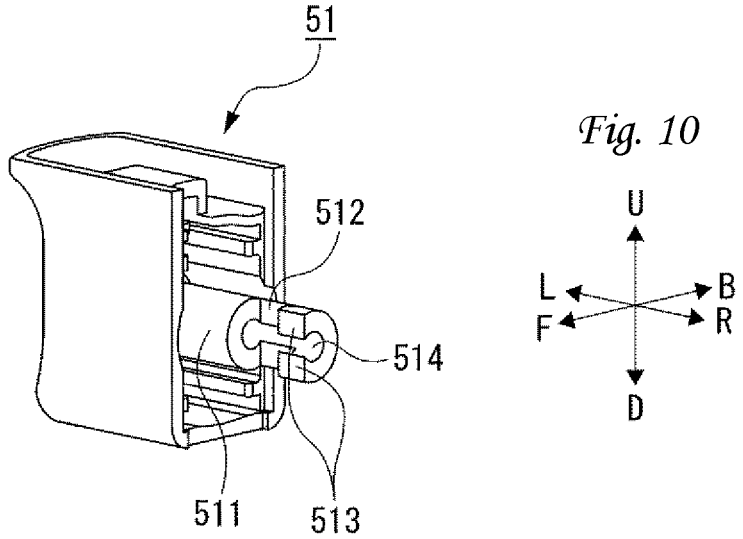
FIG. 10 is a perspective view illustrating an example of an outer member.

Referring to FIG. 10, the shaft part 511 has a hole 514 penetrating along its central axis.

The engagement part 512 has a substantially circular segmental column shape formed by cutting a part near a tip on R side of the shaft part 511 with planes substantially perpendicular to F-B direction into two parts and removing one on F side of the parts. First one of the cutting planes is located at the extreme tip on R side, and on F side with respect to the central axis. Second one is located on L side with respect to the first plane, and on B side with respect to the central axis. This forms a protrusion part 513.

Figure 11:
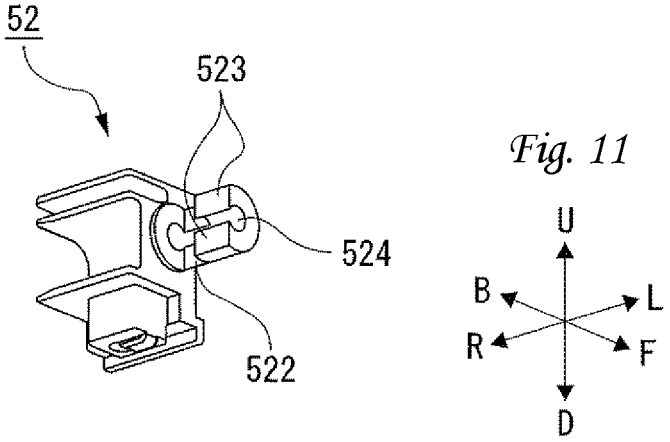
FIG. 11 is a perspective view illustrating an example of an inner member.

Referring to FIG. 11, the engagement part 522 has a shape corresponding to that of the engagement part 512. It is a substantially circular segmental column shape formed by cutting a circular column having substantially the same diameter as the shaft part 511 with planes substantially perpendicular to F-B direction into two parts and remove one on B side of the parts. First one of the cutting planes is located at the extreme tip part on L side, and on B side with respect to the central axis. Second one is located on R side with respect to the first plane, and on F side with respect to the central axis. This forms the protrusion part 523.

The engagement part 522 has a hole 524 communicating with the actuation part 526. When assembled, the hole 524 communicates with the hole 514.

Referring to FIG. 12, a process will be explained for assembling the movable part 15 to the case member 12.

First, the manipulation part 516 of the outer member 51 is took to insert the shaft part 511 of the outer member 51 through the penetration hole 231 of the case member 12 into the case member 12. The engagement part 512 is exposed in the case member 12.

Next, the inner member 52 is inserted through the opening of the case member 12 into the case member 12. The engagement part 522 of the inner member 52 is engaged with the engagement part 512, as shown in FIG. 9. Thereby, the outer member 51 and the inner member 52 are integrated. This enables to prevent the outer member 51 from falling out toward L direction. When outer member 51 moves toward R direction, the engagement part 512 presses against the engagement part 522 to move the inner member 52 toward R direction integrally with the outer member 51.

FIGS. 13 to 16 show another embodiment of the movable part 15.

Figure 13:
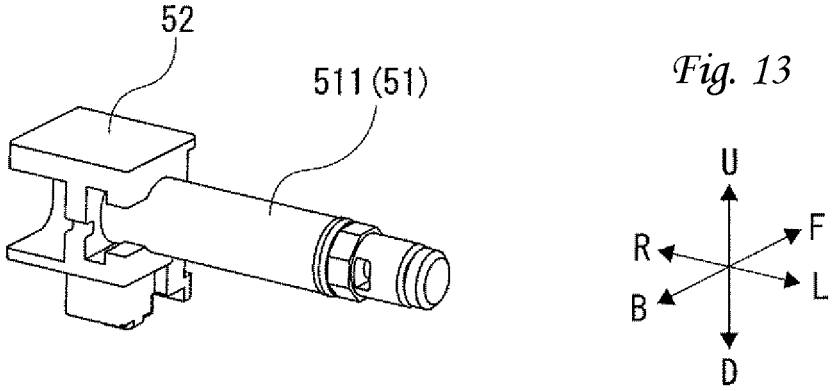
FIG. 13 is a perspective view illustrating an example of a movable part.

Referring to FIG. 13, the shaft part 511 of the outer member 51 is a discrete piece from the manipulation part 516 (not shown), and fixed with the manipulation part 516. Also, engagement parts 512, 522 for engaging the outer member 51 and the inner member 52 have a different shape from that shown in FIGS. 9 to 12.

Figure 14:
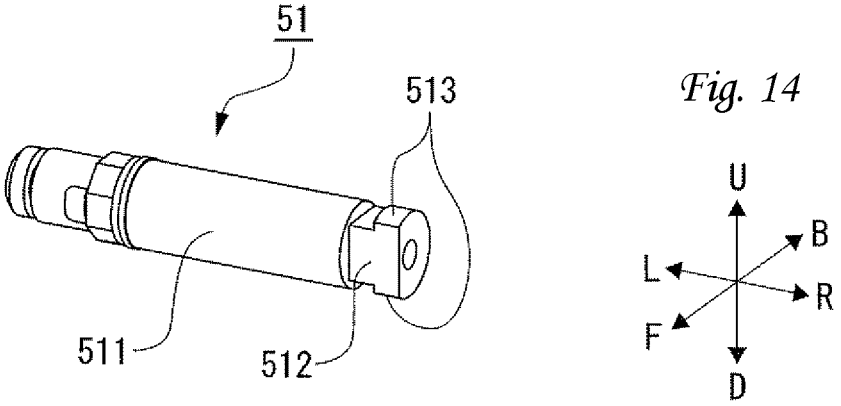
FIG. 14 is a perspective view illustrating an example of an outer member.

Referring to FIG. 14, the engagement part 512 has a substantially circular segmental column shape formed by cutting a part near a tip on R side of the shaft part 511 with a plane substantially perpendicular to F-B direction into two parts and removing one on F side of the parts. The cutting plane is located on F side with respect to the central axis of the shaft part 511. Furthermore, a part on L side with respect to the extreme tip part on R side is cut with planes substantially perpendicular to U-D direction into three parts and two of the parts on U side and D side are removed to form the protrusion part 513.

Figure 15:
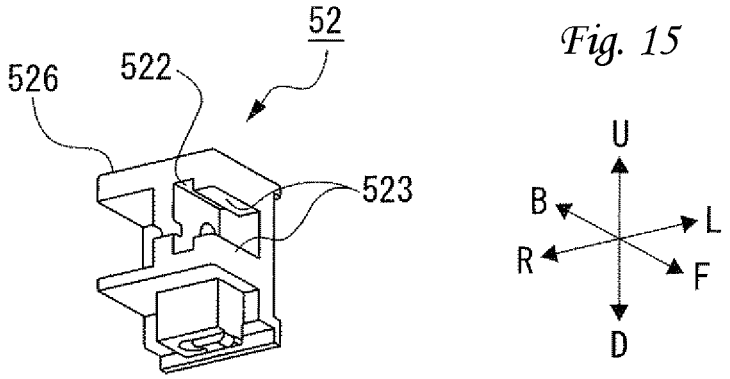
FIG. 15 is a perspective view illustrating an example of an inner member.

Referring to FIG. 15, the engagement part 522 is dented in the actuation part 526. The engagement part 522 has a shape corresponding to the engagement part 512, and protrusion parts 523 formed on U side and D side of an entrance on L side.

Figure 16:
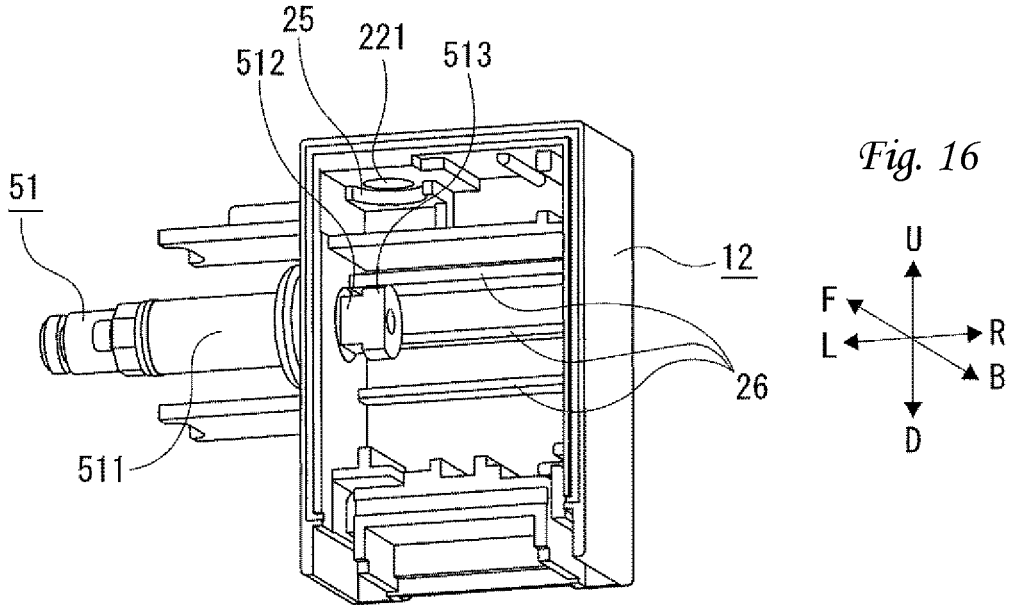
FIG. 16 is a perspective view illustrating an example of a process for assembling a switch.

Referring to FIG. 16, a process will be explained for assembling the movable part 15 to the case member 12.

First, an end on L side of the shaft part 511 is took to insert an end on R side of the shaft part 511 through the penetration hole 231 of the case member 12 into the case member 12. The engagement part 512 is exposed in the case member 12.

Next, the inner member 52 is inserted through the opening of the case member 12 into the case member 12. The engagement part 522 of the inner member 52 is engaged with the engagement part 512, as shown in FIG. 13.

In this manner, the shape of the engagement part 512 is not limited as long as it allows to be inserted through the penetration hole 231 from L direction to be exposed in the case member 12. Also, the shape of the engagement part 522 is not limited as long as it allows to be inserted through the opening of the case member 12 into the case member 12 to be engaged with the engagement part 512 exposed in the case member 12.

Figure 17:
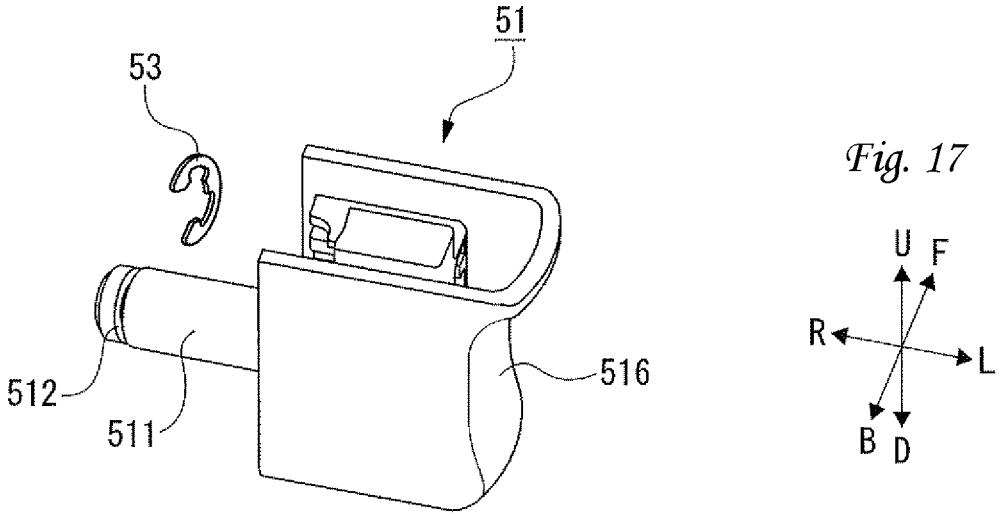
FIG. 17 is a perspective view illustrating an example of an outer member.
Figure 18:
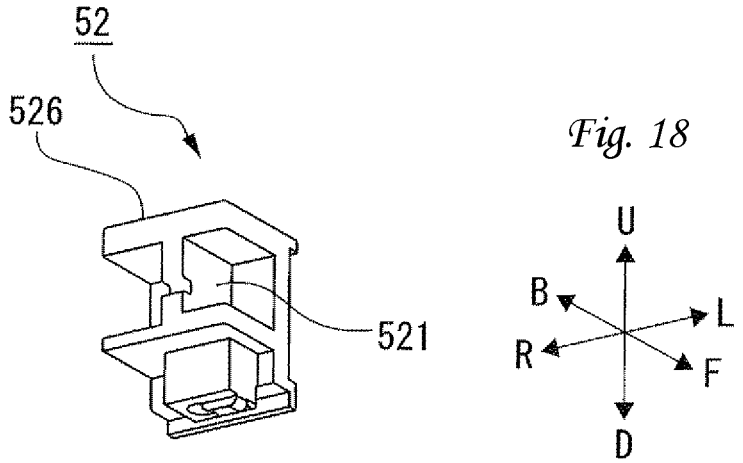
FIG. 18 is a perspective view illustrating an example of an inner member.
Figure 19:
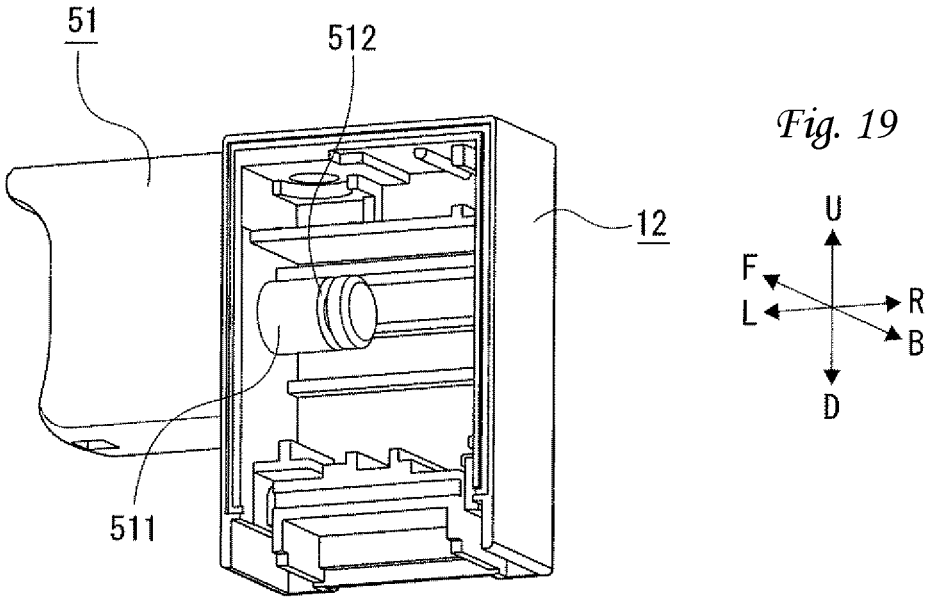
FIG. 19 is a perspective view illustrating an example of a process for assembling a switch.

FIGS. 17 to 19 show another embodiment of the movable part 15.

Referring to FIG. 17, the engagement part 512 of the outer member 51 is a groove going around the shaft part 511 near its tip. The engagement part 512 is not engaged with the inner member 52, but engaged with a retaining member 53.

The retaining member 53 is an E ring or other member for engaging with the engagement part 512 to be fixed the shaft part 511. The retaining member 53 has an outer diameter larger than an inner diameter of the penetration hole 231 of the case member 12. When assembled, this prevents the outer member 51 from falling out toward L direction.

Referring to FIG. 18, the inner member 52 has a pressure receiving part 521 (or abutting part) in place of the engagement part 522. When assembled, a tip of the shaft part 511 abuts the pressure receiving part 521.

Referring to FIG. 19, a process will be explained for assembling the movable part 15 to the case member 12.

First, the manipulation part 516 of the outer member 51 is took to insert the shaft part 511 of the outer member 51 through the penetration hole 231 of the case member 12 into the case member 12. The engagement part 512 is exposed in the case member 12.

Next, the retaining member 53 is inserted through the opening of the case member 12 into the case member 12 to engage it with the engagement part 512. This integrates the outer member 51 and the retaining member 53 to prevent the outer member 51 from falling out toward L direction.

Then, the inner member 52 is inserted through the opening of the case member 12 into the case member 12.

The inner member 52 is biased toward L direction by the biasing member 55. Thereby, a tip of the shaft part 511 abuts the pressure receiving part 521. When the user grips the manipulation part 516, the outer member 51 moves toward R direction. The tip of the shaft part 511 presses against the pressure receiving part 521 to move the inner member 52 toward R direction along with the outer member 51.

In this manner, the outer member 51 and the inner member 52 need not be engaged as long as they can move integrally.

The above described embodiments are examples to make it easier to understand the present invention. The present invention is not limited to the examples, and includes any modified, altered, added, or removed variations, without departing from the scope of the claims attached herewith. This can be easily understood by persons skilled in the art.

REFERENCE SIGNS LIST

10: switch; 11: housing; 12: case member; 13: cover member; 14, 15: movable part; 16: circuit board; 17: terminal; 18: fixed contact piece; 19, 47, 57: movable contact piece; 211: groove; 22: upper side face part; 221, 231: penetration hole; 222: recessed part; 224, 415 ring-shaped protrusion; 23: left side face part; 24: back face part; 25, 35: receiving part; 26: guiding part; 27: click feeling part; 28: right side face part; 31: elongate protrusion; 34: front face part; 41, 51 outer member; 411, 511: shaft part; 412, 422: planed part; 413,423: fixation hole; 414: circular disc part; 416, 516: manipulation part; 42, 52: inner member; 421: circular ring part; 424: fitting hole; 425: flat part; 426, 526: actuation part; 427: engagement part; 428: insertion hole; 521: pressure receiving part; 43: fixing member; 44: push rod; 45, 55 biasing member; 512, 522 engagement part; 513, 523 protrusion part; 514, 524 hole; 53: retaining member; 61: circuit; 62: packing.

The invention claimed is:

1. A switch, comprising:
a housing having a hollow box shape;
a circuit provided inside the housing; and
a movable part to be manipulated by a user to control the circuit,
wherein the housing includes:
a case member having an opened front face; and
a cover member firmly fixed with the case member to close the opened front face of the case member,
wherein the case member has a penetration hole penetrating its side face,
wherein the movable part includes:
an inner member disposed inside the housing to control the circuit; and
an outer member being a discrete piece from the inner member, and exposed outside the housing to be manipulated by the user, and
wherein the outer member includes a shaft part inserted through the penetration hole.

2. The switch of claim 1,
wherein the movable part pivots on the shaft part,
wherein the inner member has a fitting hole,
wherein the shaft part has a first end inserted into the fitting hole, and
wherein the first end of the shaft part is fitted into the fitting hole to cause the inner member to pivot integrally with the outer member.

3. The switch of claim 2,
wherein the movable part further includes a fixing member for fixing the outer member and the inner member,
wherein the outer member further includes a circular disc part provided at a second end of the shaft part, and
wherein, when the fixing member fixes the outer member and the inner member, a labyrinthine structure is formed between the circular disc part and the side face of the case member.

4. The switch of claim 3,
wherein the case member further includes a recessed part provided around the penetration hole to engage with the circular disc part, and
wherein the circular disc part has an outer face on substantially the same plane as the side face of the case member.

5. The switch of claim 3,
wherein, when the fixing member does not fix the outer member and the inner member, the outer member is allowed to move in an axial direction with respect to the inner member with retaining the first end of the shaft part to fit into the fitting hole.

6. The switch of claim 5,
wherein the inner member further includes:
a circular ring part having a fitting hole provided at its center; and
an actuation part extending from the circular ring part toward a radial direction, and
wherein, before the cover member closes the opened front face of the case member, the outer member pivoting with the first end of the shaft part fitted into the fitting hole enables a tip of the actuation part to be exposed out of the opened front face of the case member.

7. The switch of claim 6,
wherein the case member includes a receiving part on its inner side to engage with the circular ring part, and
wherein the circular ring part is engaged with the receiving part to enable the fitting hole to be positioned substantially coaxially with the penetration hole.

8. The switch of claim 1,
wherein the movable part linearly moves along an axial direction of the shaft part,
wherein the inner member includes an abutting part for abutting the shaft part, and
wherein, when the outer member is linearly moved into the housing, the shaft part presses against the abutting part to linearly move the inner member integrally with the outer member.

* * * * *